US005398363A

United States Patent [19]

Medearis et al.

[11] Patent Number: 5,398,363

[45] Date of Patent: Mar. 21, 1995

[54] SCREEN WASHING MACHINE

[76] Inventors: Mark A. Medearis; James O. Thorup, both of 767 Skylark Dr., Chico, Calif. 95926

[21] Appl. No.: 215,041

[22] Filed: Mar. 21, 1994

[51] Int. Cl.[6] ..... A47L 4/00; A46B 11/06

[52] U.S. Cl. ..... 15/104.92; 15/77; 15/160

[58] Field of Search ..... 15/40, 77, 88.1, 104.92, 15/160, 302, 308, 309.1; 134/122 R, 166 R, 198, 199; 401/10

[56] References Cited

U.S. PATENT DOCUMENTS

| | | | |
|---|---|---|---|
| 447,446 | 3/1891 | Cook | 401/10 |
| 2,546,288 | 3/1951 | Zucker | 15/40 |
| 2,682,676 | 7/1954 | Franchi | 15/77 |
| 2,962,741 | 12/1960 | Petrillo | 15/77 |
| 3,098,250 | 7/1963 | Creech | 15/77 |
| 3,178,745 | 4/1965 | Kleebauer | 15/77 |
| 3,204,271 | 9/1965 | Kingston | 15/40 |
| 3,881,209 | 5/1975 | Reinitz et al. | 134/122 |
| 4,280,672 | 7/1981 | Santos et al. | 15/40 |
| 4,502,175 | 3/1985 | Hillis | 15/104.92 |
| 5,044,036 | 9/1991 | Fujimoto et al. | 15/88.1 |

FOREIGN PATENT DOCUMENTS

| | | | |
|---|---|---|---|
| 887453 | 8/1953 | Germany | 15/40 |
| 3113891 | 10/1982 | Germany | 15/302 |
| 80817 | 10/1952 | Norway | 15/40 |
| 366179 | 1/1963 | Switzerland | 15/40 |
| 641364 | 2/1984 | Switzerland | 15/40 |

OTHER PUBLICATIONS

"Wash-A-Matic" Brochure, Wash-A-Matic Co, Aug. 1962, pp. 1–4.

*Primary Examiner*—Mark Spisich

[57] ABSTRACT

A screen washing machine that has brushes on both sides of a double trough and a controllable water spray pipe along one side. Each side of the double trough is U-shaped with the opened sides facing each other positioned horizontally in longitudinal parallel alignment with an opening between them. Two sets of dual legs support the double trough at a height approximately waist high on an operator. The legs and the two opposite sides of the double trough are not connected by upper cross supports, and a screen can be passed between them to be washed and scrubbed as it is moved through. The screen washing machine of this invention can be used to wash any flat object, a window, a door, and the like that can be passed between the double trough, and a single operator can manage the washing.

1 Claim, 4 Drawing Sheets

SCREEN WASHING MACHINE

BACKGROUND OF THE INVENTION

1. Field of the Invention

This invention relates to devices designed for washing screens and windows. The present invention is particularly directed towards a machine that allows a detached screen to be passed through a two-sided trough with the screen being washed and brushed as it passes through.

2. Description of the Prior Art

As can be seen by reading past art patents and looking at products for screen washing available in the market place, no serious attempts to provide a useful portable screen washing machine seems to have been made. This is particularly true of a complete device for washing and brushing screens that can be operated by a single person. Washing screens can become a difficult occupation using equipment presently available for the purpose.

SUMMARY OF THE INVENTION

In practicing our invention, we overcome this difficulty by providing complete washing and brushing of detached screens in a machine washer having two U-shaped troughs with the opened ends of the U facing each other. The troughs are affixed with pliable brushes and a spray water system. The washer is easily operated by a single person but is also sufficiently versatile to efficiently wash and brush most any flat item that can be passed between the two trough sides by one or more persons holding the flat item in an upright position.

Therefore, a principal object of our invention is to provide a screen to washing machine having brushes on both sides of a double trough with a controllable spray pipe along one side through which a screen can be passed for washing and scrubbing.

Another object of the invention is to provide a double trough with brushing and spraying facilities for washing screens that is mounted on legs so the device is in a convenient use position approximately waste high to an operator.

A further object of our invention is to provide a screen washing machine having a controllable water spray for washing and rinsing screens, windows, and other flat objects.

A still further object of this invention is to provide a screen washing machine that is simple to use and can be easily managed by a single operator.

Another object of our invention is to provide a screen washing machine in a take-apart stand that can be easily assembled and disassembled making the present invention a highly portable device.

Other objects and the many advantages of the present invention will become clear from reading the following specifications and comparing numbered parts described with the same numbered parts illustrated in the drawings.

DESCRIPTION OF THE PREFERRED EMBODIMENTS

Figure 1:
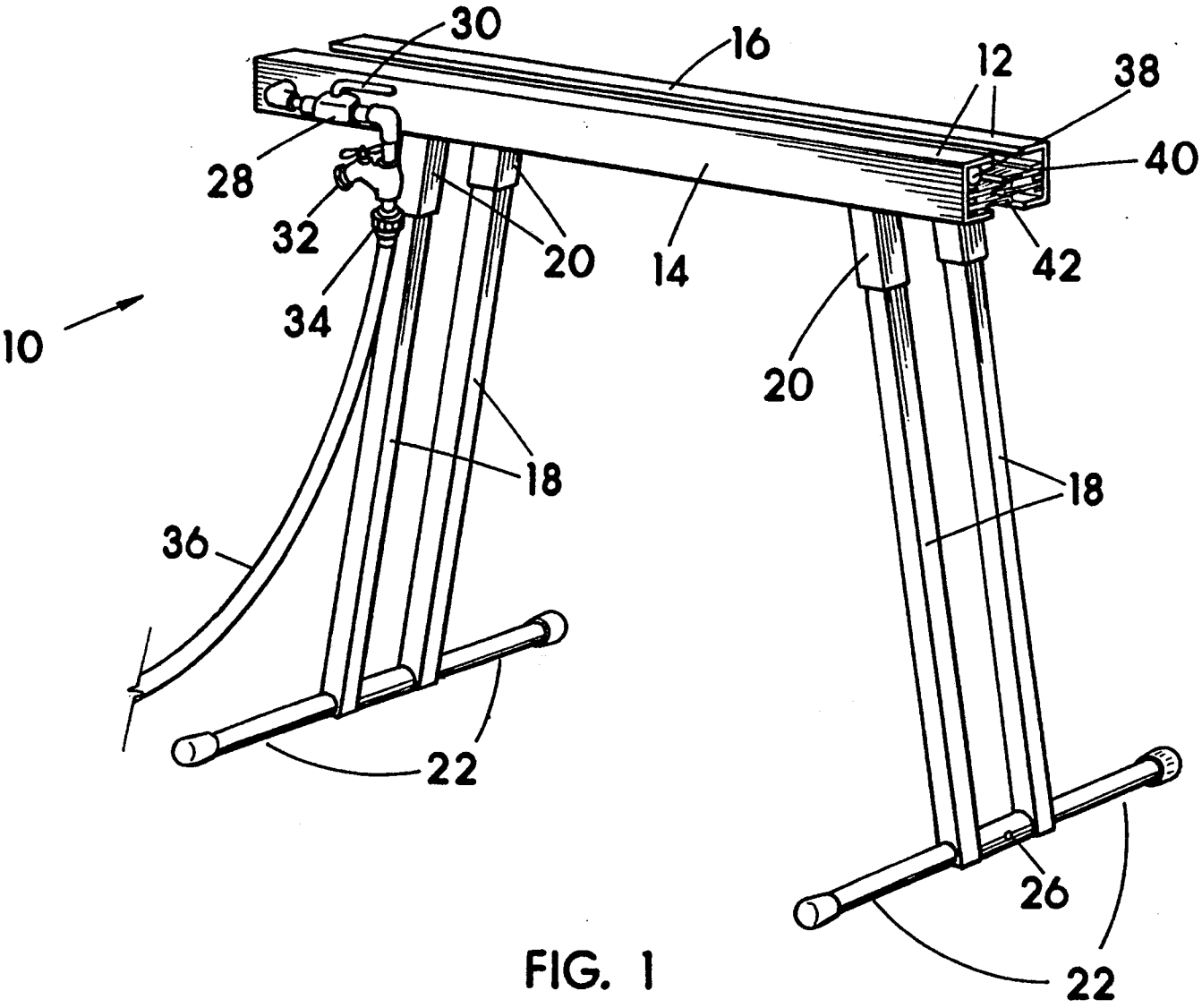
FIG. 1 shows a screen washing machine according to the invention with the take-apart stand assembled and the double trough positioned ready for use.
Figure 2:
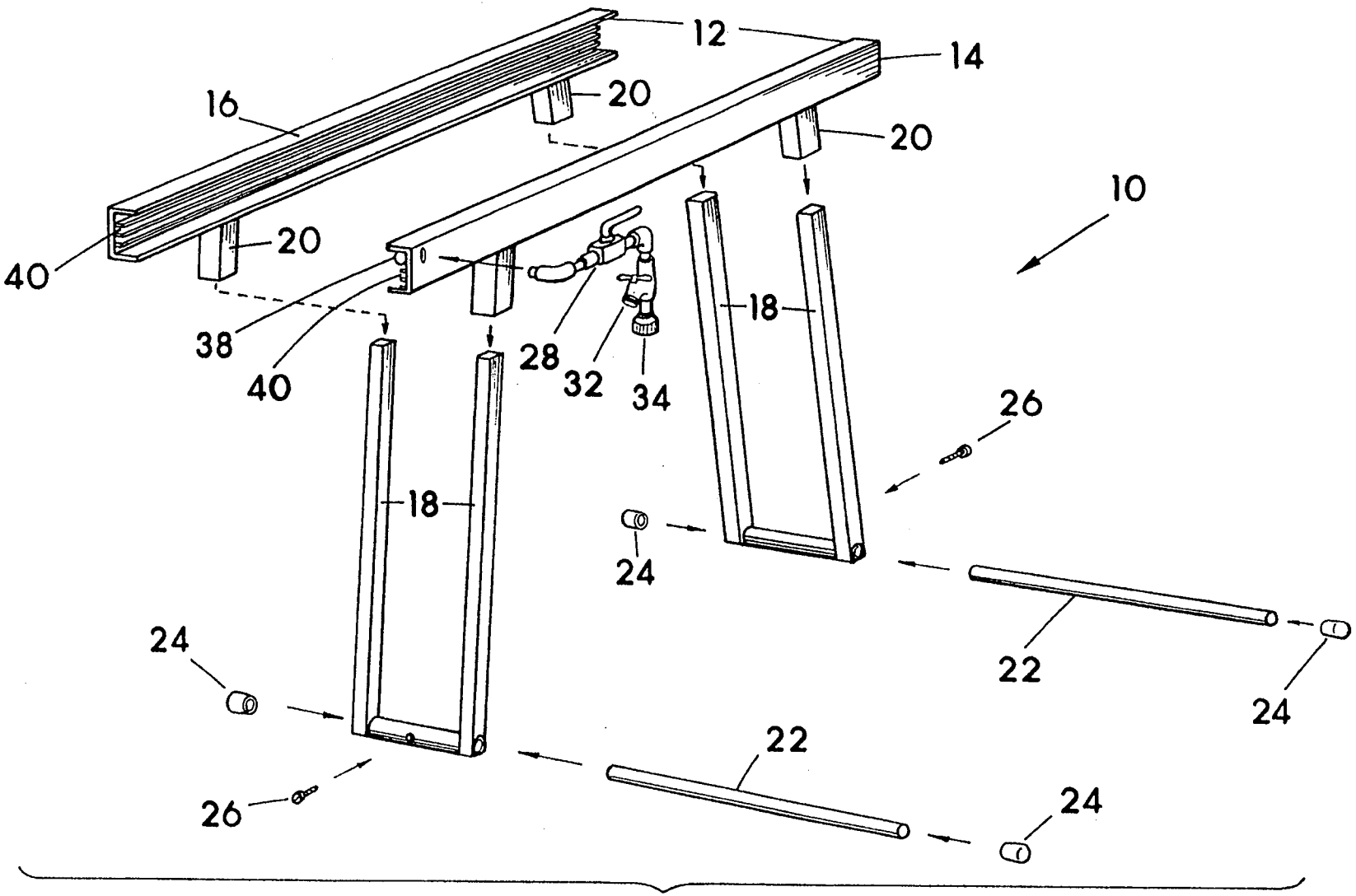
FIG. 2 shows the screen washing machine of FIG. 1 with the take-apart stand disassembled in an exploded view. No brushes are installed and the brush channels are visible along the inside of the uppermost trough section. The end of the spray tube and the water supply fixtures can be seen at the lower trough section end. The two troughs are positioned for assemblage in parallel alignment and form a single double trough when assembled. The end legs, the leg support rods (prevent tipping), and the support leg end caps are in position for assembly.

Referring now to the drawings at FIG. 1 and FIG. 2. In FIG. 1, the invention, screen washer 10, is shown assembled, ready for use. Trough assembly consisting of washer/brush side 14 and brush side 16 are shown supported approximately waste high to an operator (FIG. 6) by vertical legs 18. Vertical legs 18 attach slide-in to trough sides 14 and 16 by rigid leg receivers 20 and slant outward endwise to the trough sides 14 and 16 one pair at each end. At the lower ends, legs 18 are stabilized by leg support rods 22 passed through a tubular leg cross support and affixed by self-threading bolts 26. Leg support rods 22 prevent washer 10 from tipping when in use. Plumbing assembly 28 with manually operated controller 30, an ON/OFF ball valve lever, is at the upper end on the outside of double trough assemblage 12. Water spigot 32 and hose connector 34 with garden hose 36 connected are at the lower end of plumbing assembly 28. The end of spray tube 38 can be seen in the foreground end of trough assembly 12. The ends of brush receiving channels 40 and brushes 42 are also visible. The disassembled, exploded view at FIG. 2 shows the various parts that make up washer 10. The two parallel trough sides 16 and 14 are shown with brushes 42 removed and brush receiver channels 40 visible in trough side 16. The end of spray tube 38 and the ends of channels 40 show in trough side 14. Leg receivers 20 are attached on the bottom side of both trough sides 14 and 16, one at each end. Leg receivers 20 accept insertion of the assemblies of legs 18 and are deep enough to hold the assemblies of legs 18 firmly and angled out downwards as illustrated in FIG. 2. For addition support and to prevent washer 10 from tipping, leg support rods 22 pass through the connector tubing at the foot of both legs 18. With leg support rods 22 centered in the connector tubing, self threading bolts 26 are applied and maintain the central position of leg support rods 22. Rubber leg tips 24 are slid over the ends of leg support rods 22 to finish of the ends and to help prevent washer 10 from slipping when in use. Plumbing assemblage 28 is shown with an arrow line indicating where it attaches to trough side 14. Two principal parts of plumbing assemblage 28 are water spigot 32 and hose connector 34. Hose connector 34 is where a garden hose (see 36 in FIG. 1) is attached to plumbing assemblage 32 for supplying water to plumbing assemblage 28 and to spray tube 38. Water spigot 32 allows for drawing water to fill a bucket or for attachment of another washer hose.

Figure 3:
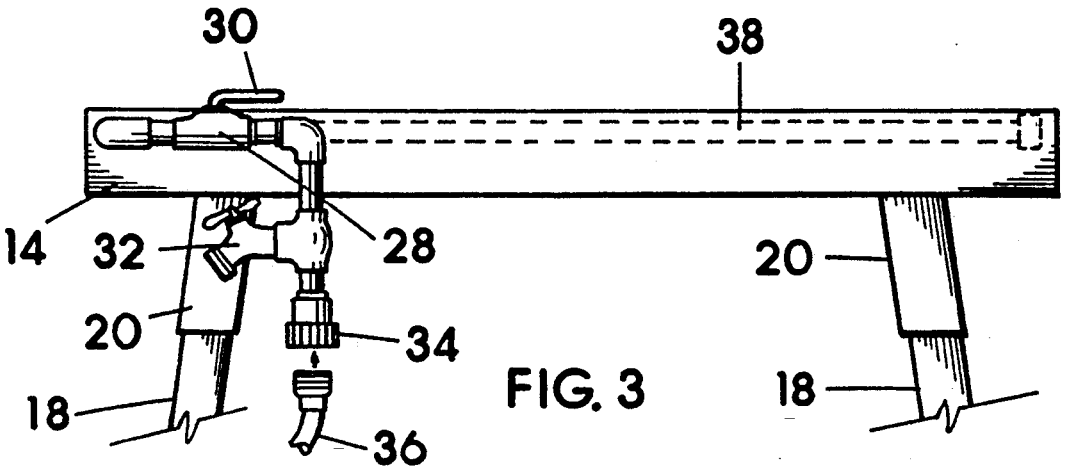
FIG. 3 shows an side elevation view of the double trough assembly. The internal spray tube is illustrated by dotted lines.
Figure 4:
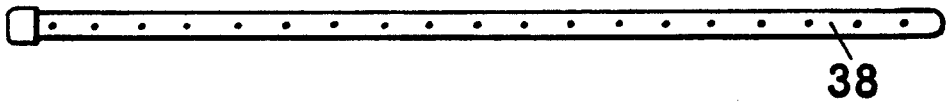
FIG. 4 shows the spray tube only in a reversed position so the alignment of spray apertures can be seen.

In FIG. 3, a side view of the trough assemblage is shown from the trough side 14. Upper section of legs 18 are shown installed by insertion into leg receivers 20. An end section of garden hose 36 is shown with an arrow indicating where it would attach to hose connector 34 in plumbing assemblage 28. Water spigot 32 is in the center of plumbing assemblage 28 and the ON/OFF lever 30 operating a ball valve that controls the flow of water to spray tube 38 (shown in dotted lines) is at the top in this illustration. FIG. 4 shows spray tube 38 only with spray tube 38 turned around so the spray apertures aligning the inside can be seen.

Figure 5:
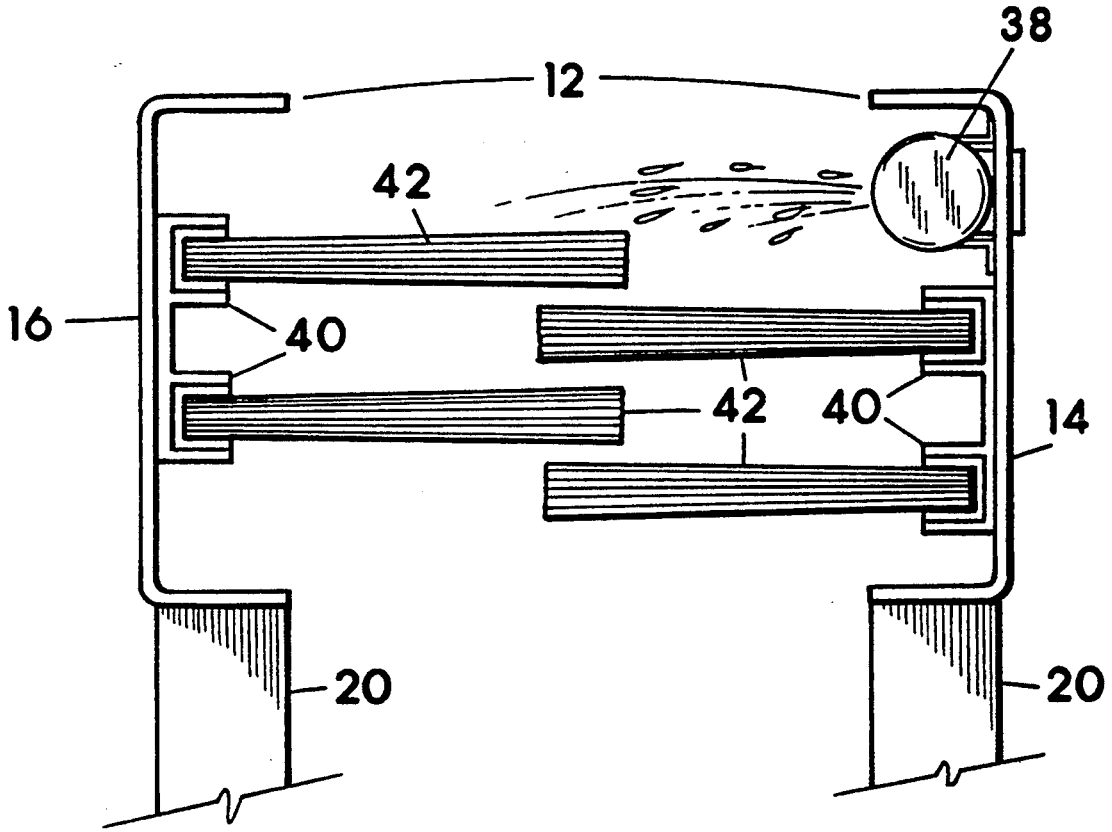
FIG. 5 shows an enlarged view of the double trough assembly endwise with the brushes installed and water being sprayed from the water tube. The trough is two-piece. The two pieces are U-shaped with the opened sides facing and paralleling each other. Pliable, removable brushes in brush channels on each side of the troughs transverse each other.

FIG. 5 is an enlarged view of the end of double trough assemblage 12 with brushes 42 installed. Troughs sides 14 and 16 are U-shaped with the opened ends of the U facing each other. Channels 40, that hold brushes 42 removable, are in offset positions two on each inside wall of troughs sides 16 and 14. Brushes 42 overlap but are sufficiently pliable to allow a screen, a window, or another flat object to be passed between them. Spray tube 38 is inside at the top of trough side 14 and is illustrated spraying water over brushes 42. Leg receivers 20 are attached to the bottom surfaces of trough sides 16 and 14.

Figure 6:
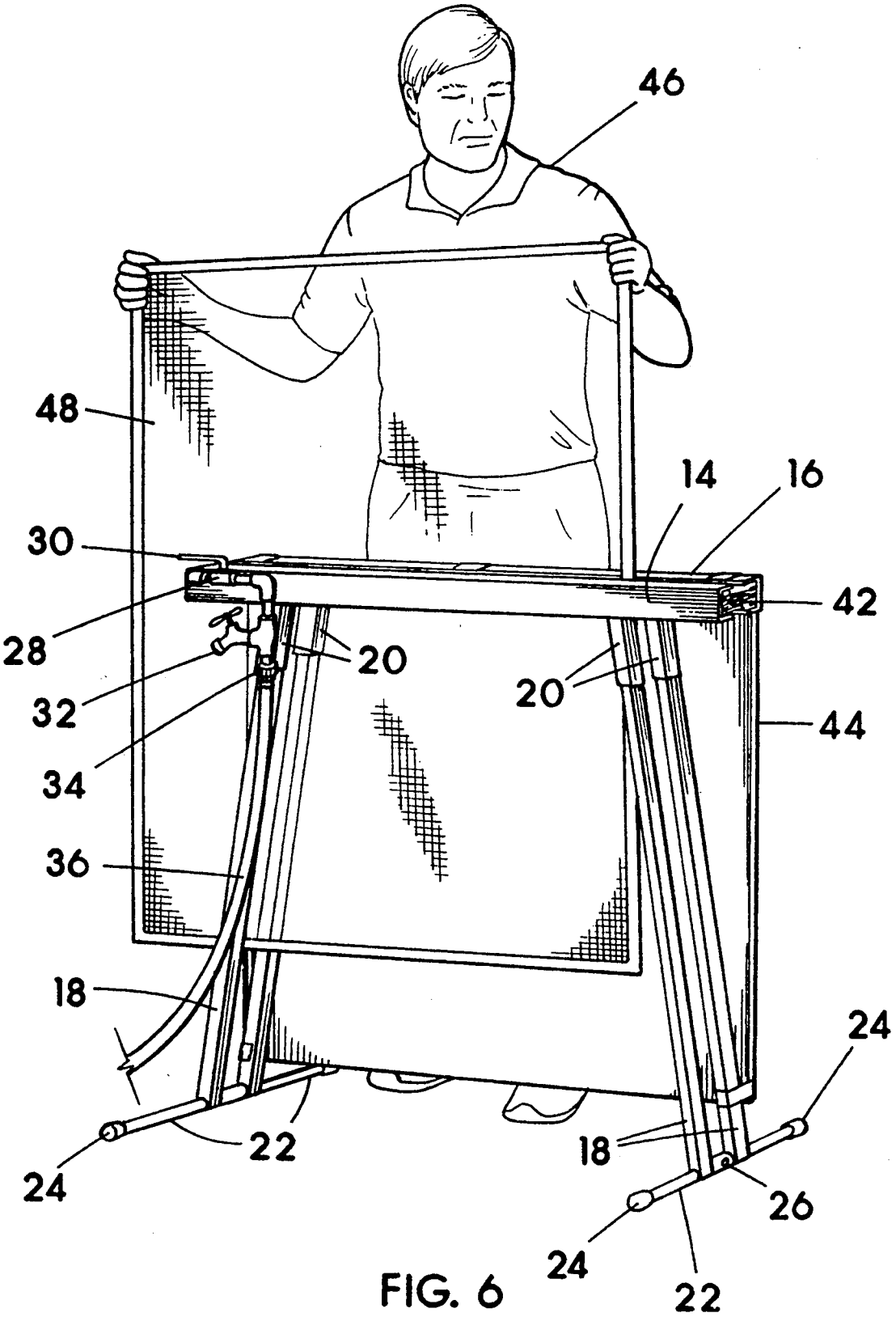
FIG. 6 shows the screen cleaning machine in accordance with the invention in use by a single operator. An optional splash guard is illustrated installed on the user's side of the machine.

The in-use illustration at FIG. 6 shows a man as operator 46 using washer 10 to wash a screen 48. Operator 46 is protected from being splashed on by splash guard 44 which attaches to the back side of trough side 14 and hangs down almost to leg supports 22. Splash guard 44 is a rubberized sheet of material that can be detached from trough side 14, rolled or folded for packaging or storage. Water is supplied from garden hose 36 to plumbing assemblage 28 with the volume of water passed on to spray tube 38 (inside trough side 14 and not seen this illustration) being controlled by ON/OFF lever 30. Although operator 46 can stand on either side of washer 10, the normal use position would be as illustrated on the trough side 16 side. In FIG. 5, the relative positions of trough sides 14 and 16 to ON/OFF lever 30, leg receivers 20, water spigot 32, hose connector 34, legs 18, and leg support rods 22. The angling of legs 18 outwardly at the lower ends and the crosswise position of leg support rods 22 provides washer 10 with stability when in use. Washer 10, according to the invention, is quite versatile in that most any flat item such as windows, doors, and the like that can be passed between trough sides 14 and 16 by one or more operators 46, can be cleaned by the present invention.

Although we have described a principal embodiment of our invention with considerable detail in the foregoing specification and have illustrated it extensively in the drawings, it is to be understood that we may practice variations in the invention which do not exceed the scope of the appended claims. Also, any variation of the present invention practiced by others that falls within the scope of the claims following, shall consider to be our invention.

What is claimed is:

1. An apparatus for washing a planar element, said apparatus comprising:

a. a pair of elongated U-shaped members, each of said members having an elongated trough extending along substantially the entire length thereof;

b. means for connecting said members such that they are parallel to each other and spaced about the entire peripheries thereof to define a space therebetween for receiving the planar element to be cleaned, said means for connecting including leg members for supporting said U-shaped members approximately waist high to a user and substantially parallel to a support surface, said U-shaped members being spaced such that the planar element is adapted to be inserted in a vertical plane substantially transverse to the longitudinal axis of said U-shaped members;

c. a pair of brushes each disposed within and extending along the length of a trough of a respective one of said U-shaped members, said brushes extending into the space between said U-shaped members;

d. an elongate spray tube located within and along the length of the trough of one of said U-shaped members, said spray tube including a plurality of apertures along the length thereof which are adapted to direct a spray of water into the space between the U-shaped members and toward the other of said U-shaped members;

e. means for supplying water to said spray tube, said means for supplying including valve means for turning the supply on and off and for controlling the volume and thus the velocity of the water exiting the apertures of said spray tube;

f. whereby the planar element may be positioned into said space by a user and the brushes engage the opposite surfaces of said planar element and water from said spray tube is directed to contact said planar element to wash away any debris thereon.

* * * * *